United States Patent [19]

Rüegger et al.

[11] 3,970,256

[45] July 20, 1976

[54] GRINDING MILL

[75] Inventors: Edgar Rüegger, Arnegg; Stefan Meister, St. Gallen, both of Switzerland

[73] Assignee: Buhler AG, Uzwill, Switzerland

[22] Filed: Jan. 16, 1975

[21] Appl. No.: 541,408

[30] Foreign Application Priority Data

Jan. 18, 1974 Switzerland ..... 688/74

[52] U.S. Cl. ..... 241/231; 100/176; 241/234

[51] Int. Cl.[2] ..... B02C 4/34

[58] Field of Search ..... 241/230–234; 100/168, 176

[56] References Cited

UNITED STATES PATENTS

| | | | |
|---|---|---|---|
| 269,459 | 12/1882 | Poole, Jr. | 241/232 |
| 322,432 | 7/1885 | Eisenberg | 241/232 |
| 2,080,364 | 5/1937 | Tunley et al. | 241/232 X |
| 2,713,460 | 7/1955 | Atkinson | 241/232 X |
| 3,099,406 | 7/1963 | Kautz | 241/231 X |
| 3,208,678 | 9/1965 | Pick et al. | 241/231 |
| 3,845,708 | 11/1974 | Liebert | 100/176 X |
| 3,881,663 | 5/1975 | Brown | 241/232 X |

*Primary Examiner*—Granville Y. Custer, Jr.
*Assistant Examiner*—Howard N. Goldberg
*Attorney, Agent, or Firm*—Michael J. Striker

[57] ABSTRACT

Grinding rolls are provided on a support, each having opposite axial ends provided with respective trunnions. Open-and-shut journals are provided on the support for the respective trunnions. A displacing arrangement is engageable with the trunnions of each grinding roll and pivotable between a first end position in which the trunnions of a respective grinding roll are located in their associated journals, and a second end position in which the grinding roll and the trunnions thereof are laterally displaced relative to the first position and supported by the displacing arrangement.

26 Claims, 5 Drawing Figures

GRINDING MILL

BACKGROUND OF THE INVENTION

The present invention relates in general to a grinding mill, and more particularly to a grinding mill with removable grinding rolls.

It is well known to those conversant with this art that high requirements as to dimensional accuracy and tolerance limitations are made of the grinding rolls used in grinding mills. This is, in fact, true not only of these factors, but also with respect to the position of the grinding rolls in the grinding mill. It is clear that if these requirements are not met, the action of the grinding rolls will not be satisfactory. Because of the requirements made of the dimensional accuracy of the grinding rolls, the latter must be frequently disassembled from the grinding mill, machined (e.g. re-ground) and reinstalled.

The grinding rolls can be mounted in the grinding mill in one of two ways, either by means of undivided journals or bearing bodies, or by means of bi-partite journals or bearing bodies. The use of undivided bearing bodies has the disadvantage that when the grinding rolls have to be removed, the bearing bodies themselves must also be removed, and subsequently each grinding roll with its bearing bodies must be re-installed, whereupon the bearing bodies must be adjusted until they are in the proper position to thereby assure that the grinding roll also assumes the proper position, a time-consuming and expensive operation which may require hours of work to complete.

For this reason the prior art generally prefers the use of bi-partite bearing bodies in order to hopefully eliminate much of the adjusting work. These bearing bodies have two sections one of which is firmly and permanently mounted in the grinding mill, whereas the other section is removable when a grinding roll is to be disassembled from the grinding mill. When the grinding rolls are subsequently to be reinstalled, their trunnions are inserted into the fixed bearing section and the removable bearing section is then re-installed to form a complete bearing body together with the fixed bearing section. The fixed bearing section is precisely positioned, often with a tolerance of only a few hundredths of a millimeter, and it is clear that to properly position the trunnions of one of the grinding rolls —which latter may weigh hundreds or even thousands of kilograms— under these circumstances is a very difficult and highly skilled undertaking. The slightest error can result in significant damage to the grinding roll, the bearing or the bearing body, and all of this is constantly accompanied by the danger that the grinding roll might slip during the adjustment and might cause even worse damage or possibly an injury to the workers. This is all the more true as in many instances where such grinding mills are used, for example in oil mills, fodder mills and the like, the use of heavy overhead cranes for holding and manipulating the grinding rolls is impossible because of the required large number of vertical conduits which extend upwardly from or downwardly to the grinding mill and which physically preclude the use of an overhead crane. For this reason it is necessary to use block and tackle and similar devices for lifting the grinding rolls out of their journals and replacing them in the journals, and to hold them during the adjustment, which latter operation requires still additional tools. All in all, the use of bi-partitie journals has also not been very satisfactory in the prior art.

To summarize the state of the art, it can be pointed out that if the grinding rolls are journalled in undivided journals, the installation and removal of the grinding rolls together with their journals is quick, but the adjustments required for the journals after installation is extremely time-consuming and difficult. If bi-partite journals are used for the grinding rolls, then the installation and removal is also relatively quick, but the actual insertion and removal of the grinding roll trunnions with reference to the associated journals is time-consuming and connected with great difficulties, because it requires so high a precision that this work can be carried out only very slowly and with great skill. Added to this is the fact that there is an ever-present possibility of accident, for reasons which have been explained above.

SUMMARY OF THE INVENTION

Accordingly, it is a general object of this invention to overcome the aforementioned disadvantages.

More particularly, it is an object of the present invention to provide an improved grinding mill which is not possessed of these disadvantages.

Still more specifically, it is an object of the present invention to provide an improved grinding mill having grinding rolls that can be removed and reinstalled, and which has certain specific advantages not found singly or in combination in the prior art, namely a rapid removal and reinstallation of the grinding rolls, the elimination of adjustments on installation thereof, the removal and installation of the grinding rolls without danger of damage to rolls or journals, the reduction of accident risks to an absolute minimum, and the possibility of removing and installing grinding rolls without the aid of highly skilled specialists, so that the work can be performed even by semi-skilled workers.

In keeping with the above objects, and others which become apparent hereafter, one feature of the invention resides in a grinding mill which, briefly stated, comprises support means, grinding rolls each having opposite axial ends provided with respective trunnions, and open-and-shut journals for the respective trunnions. There is further provided displacing means enggeable with the trunnions of each grinding roll and pivotable between a first end position in which the trunnions of a respective grinding roll are located in their associated journals, and a second end position in which the grinding roll and the trunnions thereof are laterally displaced relative to the first position and are supported by the displacing means.

It is advantageous if the open-and-shut journals are not only of the bi-partite type, but if their plane of separation is substantially vertically oriented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
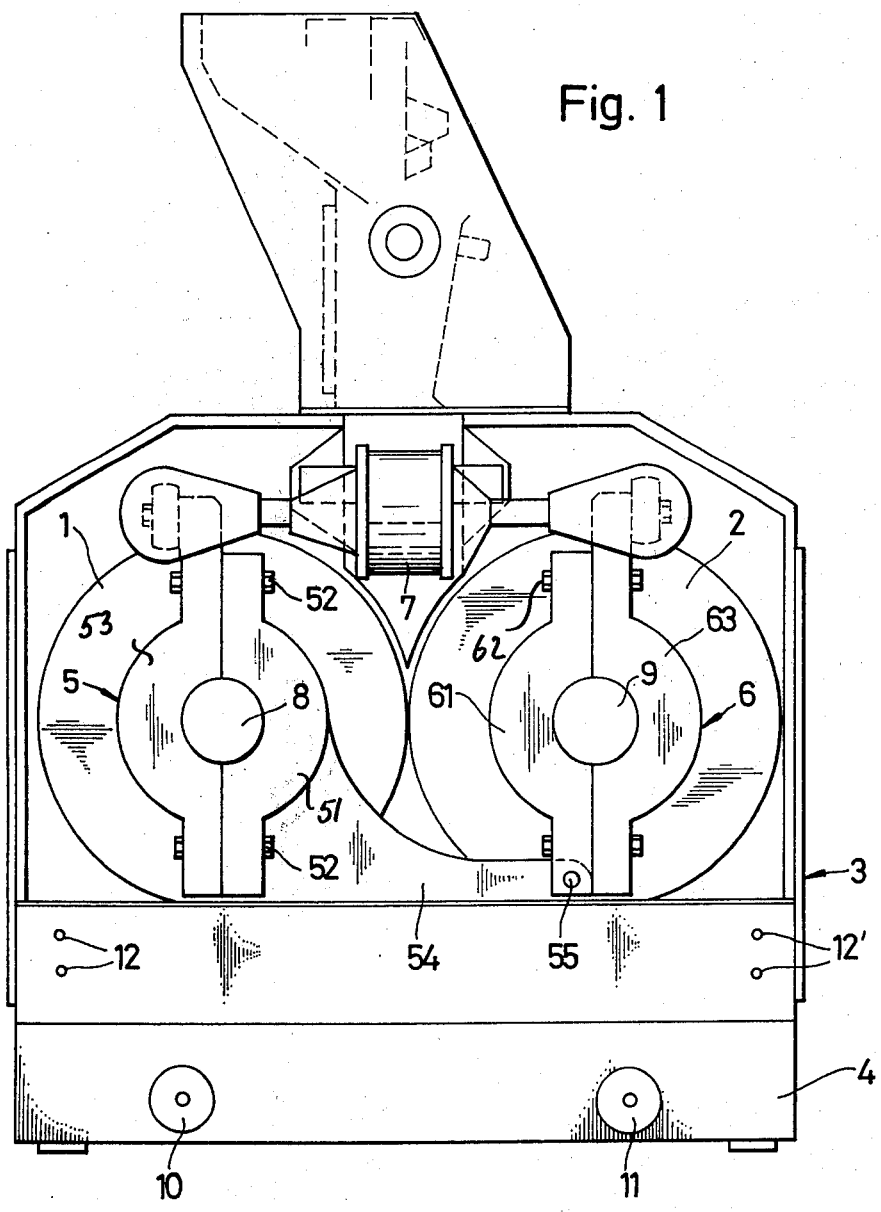
FIG. 1 is a very diagrammatic end view of a grinding mill according to the present invention.

FIGS. 1–5 show a single exemplary embodiment of the invention. In these Figures, or more particularly in FIGS. 1 and 2, a grinding mill is illustrated having a pair of grinding rolls 1 and 2 of which only those axial ends are visible that face the viewer. The arrangement is entirely symmetrical so that it will be understood that the grinding roll 1 is provided with axially extending trunnions 8 at each axial end, just as the opposite axial ends of the grinding roll 2 are also provided with respective trunnions 9. The rolls 1 and 2 are turnably mounted in a support 3 having a base frame 4 which carries a pair of open-and-shut journals or bearing bodies 5 for the grinding roll 1, and a pair of similar journals or bearing bodies 6 for the grinding roll 2. Only one journal 5, 6 of each pair is visible.

It is currently preferred that the journals 5 and 6, which are bi-partite and composed of the journal sections 51, 53 (for the journal 5) and 61, 63 (for the journal 6) each have a substantially upright plane of separation in which the sections 51, 53 and 61, 63 engage one another. This plane of separation may include with the vertical an angle of at most 30°.

The section 51 of the journal 5 is fixedly connected with the support frame 4, and the section 53 is releasably secured to the section 51 by means of screws 52. A pivot 55 is provided on the base portion 54 that is fixedly mounted on the frame 4, and the section 61 of the journal 6 is pivotably connected to the pivot 55. Screws 62 serve to releasably secure the section 63 to the section 61. A hydraulic cylinder 7 is pivoted to the sections 53 and 63 (or could be pivoted to the sections 51 and 61), so that the grinding roll 2 can be pressed against the grinding roll 1 with an adjustable pressure that depends upon the pressure supplied to the cylinder 7.

Figure 3:
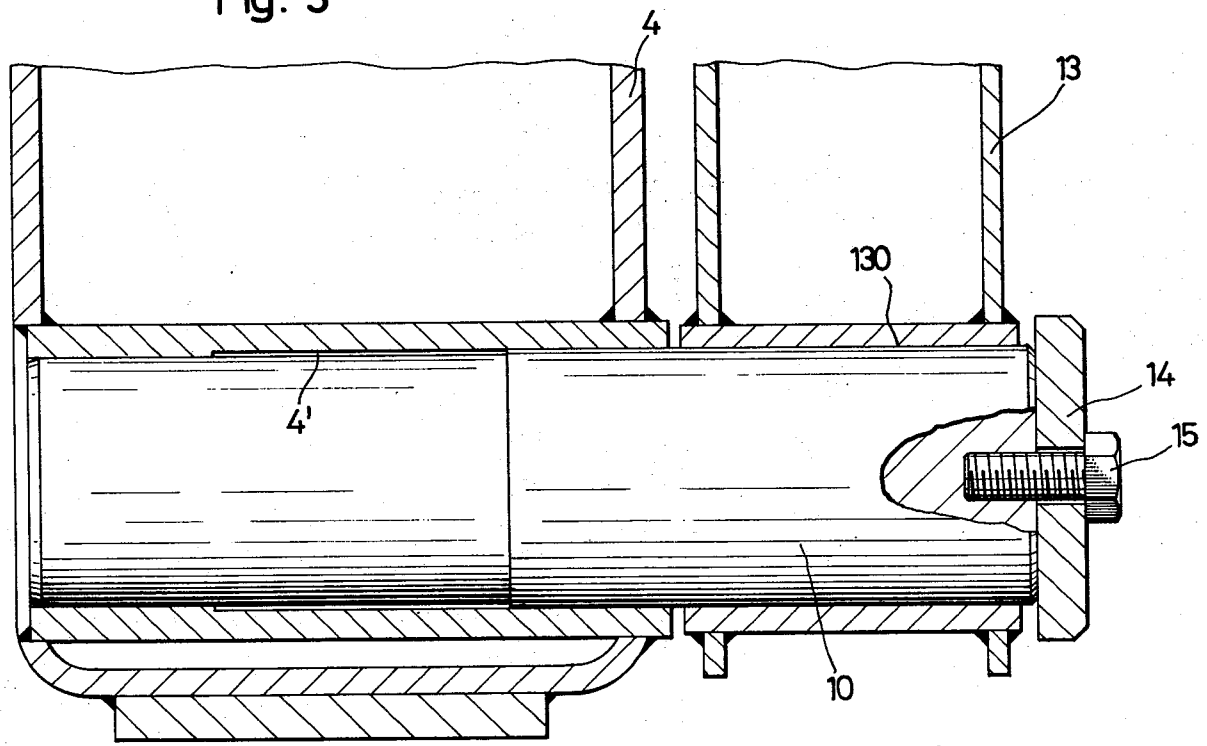
FIG. 3 is a section taken on line III—III of FIG. 2, on an enlarged scale.
Figure 4:
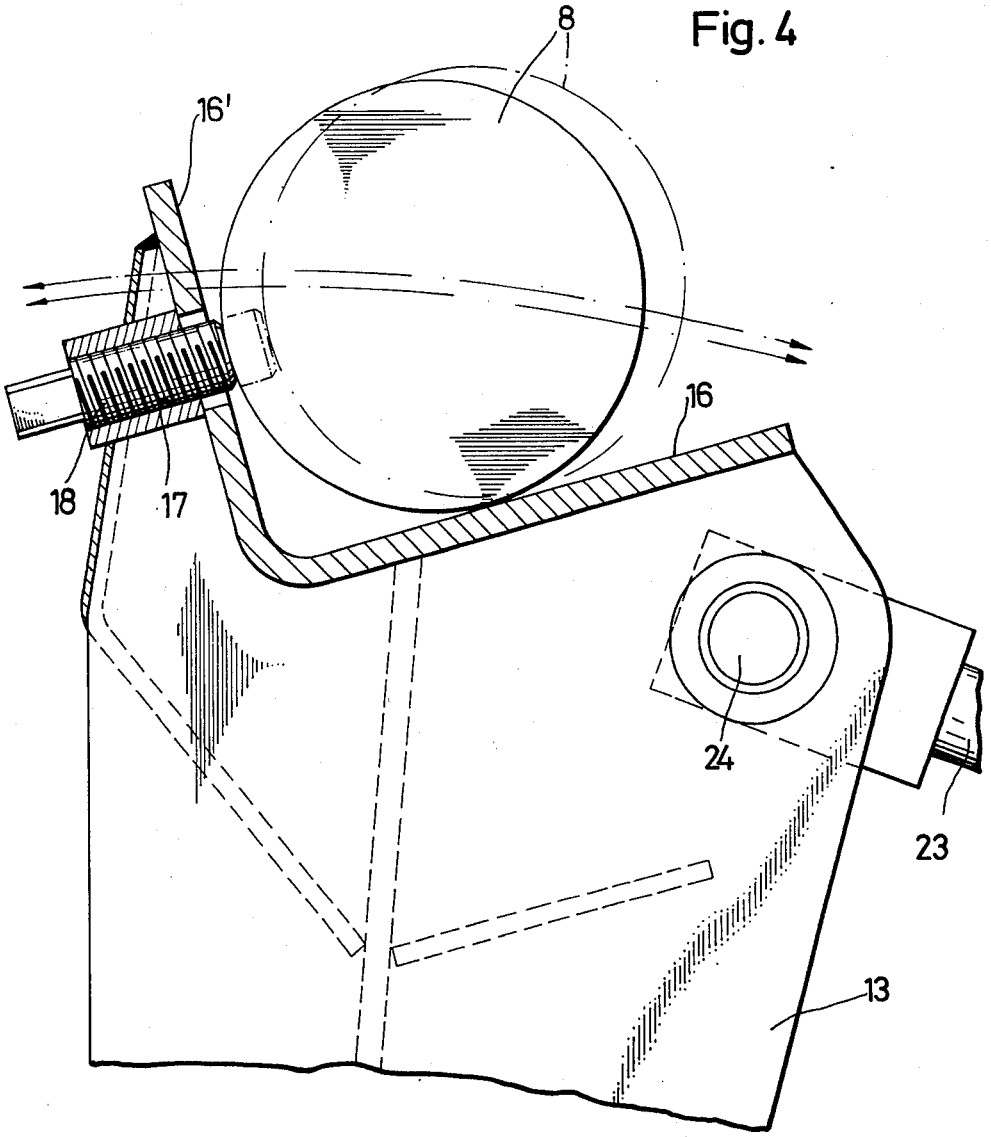
FIG. 4 is a partly sectioned fragmentary detailed view, showing a detail of FIG. 2 on an enlarged scale.

The axial ends of the trunnions 8 and 9 project axially beyond the journals 5 and 6, respectively. Located downwardly of the trunnions 8 and 9, and provided on the frame 4, are two pivots 10 and 11 which have counterparts at the opposite (not visible) end of the machine. As FIG. 3 shows, the pivots 10 and 11 are press-fitted into respective cylindrical bores 4′ in the frame 4, but it will be appreciated that they could for example also be welded to a base plate and the base plate could then be secured to the frame 4 by means of screws or the like. The frame 4 is also provided with tapped bores 12 and 12′, which again have counterparts at the opposite not visible end of the machine. The construction of the journals 5 and 6 at this opposite end is identical with the one that has been illustrated, so that a description of the visible end of the machine will suffice for a proper understanding of the invention.

If it is assumed that the grinding roll 1 is to be removed from the machine, a lever 13 having a sleeve 130 (compare FIG. 3) is placed onto the pivot 10. A similar lever is placed onto the second pivot 10 that is provided at the not visible end of the machine. Each lever 13 is provided at its upper end (compare FIGS. 2 and 4) with a receiver bounded by two abutment surfaces 16 and 16′ which extend at right angles to one another. The abutment surface 16′ is formed with a tapped bore 17 in which a screw 18 is turnably received. When the screw 18 is turned it moves in a path that extends along the surface 16, substantially parallel to the same, and at right angles to the trunnion 8. Thus, when the screw 18 is turned so that it shifts towards the right in FIG. 4, the trunnion 8 is pushed along the surface 16 towards the right so that the tilting radius in which the axis of the trunnion 8 can tilt when the levers 13 are moved from the full-line position of FIG. 4 to the broken-line position, is changed, as a comparison of the full-line showing of the trunnion 8 in FIG. 4 with the broken-line showing thereof will clearly indicate.

Figure 2:
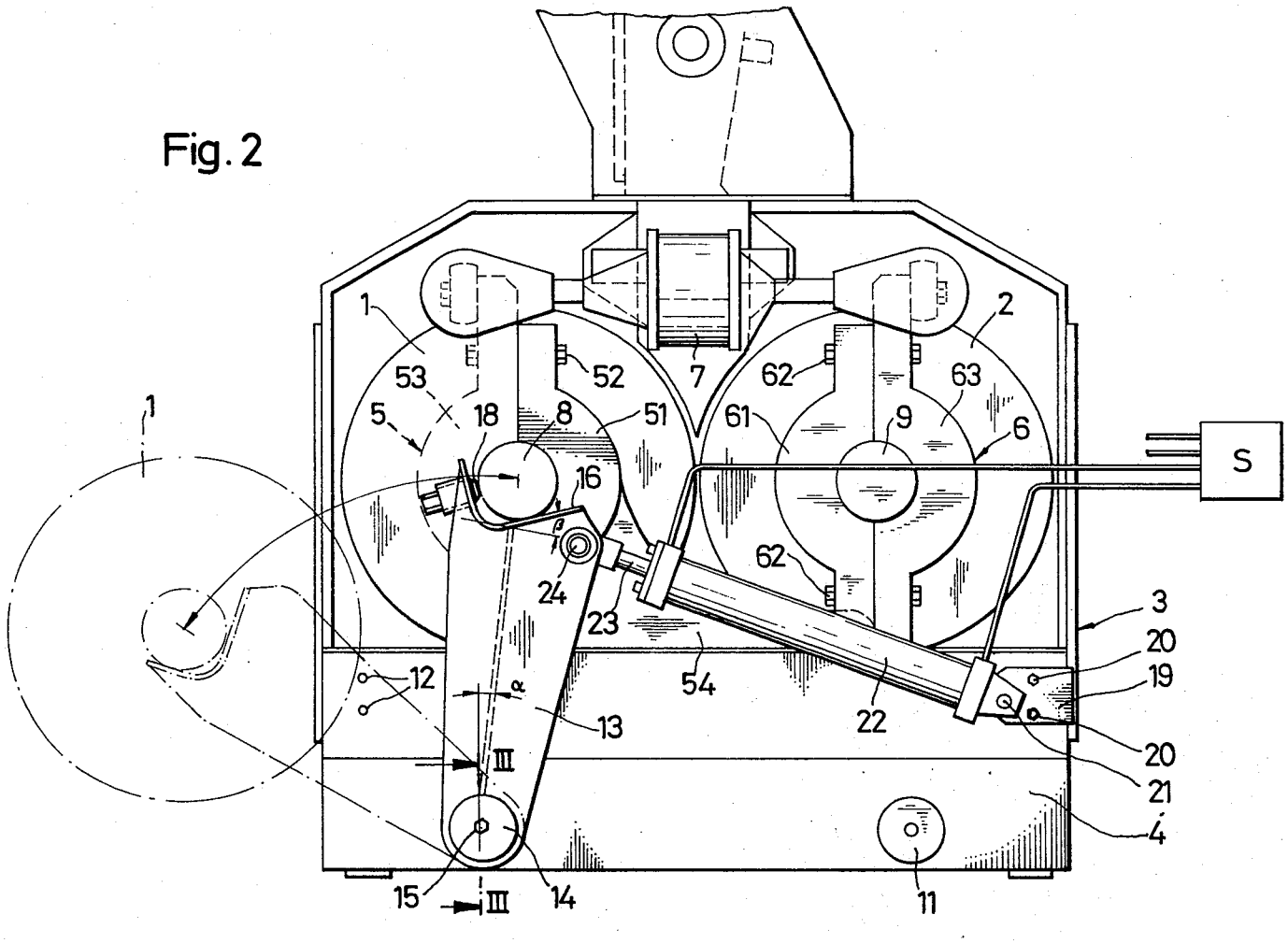
FIG. 2 is a view similar to FIG. 1, but showing the displacing means of the invention in readiness for use with one of the grinding rolls.

To remove the grinding roll 13, the levers 13 are so mounted on the pivots 10 that the abutment surfaces 16, 16′ of the respective receivers embrace the respective trunnions 8 and the levers 13 are located in the inner end position or starting position shown in broken lines in FIG. 2. Each lever 13 is mounted on the respective pivot 10 and prevented against slipping off by means of a cover plate 14 which is held in place by a screw 15.

The abutment surface 16 of each receiver intersects the tangent to the tilting circle at an acute angle $\alpha$, and the longitudinal central axis of each lever 13 includes with a vertical plane passing through the axis of the pivot 10 an acute angle $\alpha$ which is preferably in the range of 3°–30°, but no higher than 45°. Because of this construction a torque is exerted upon the respective levers 13, especially when the weight of the grinding roll 1 rests upon the receivers of the respective levers 13, which urges the levers 13 inwardly, tending to maintain them in the full-line position and to prevent their accidental displacement to the broken-line position of FIG. 2. This evidently is a significant contribution to a reduction in the possibility of an accident during adjustments.

A mounting member 19 is secured at the right-hand side of the frame 4 by means of screws 20 which are threaded through the member 19 into the tapped bores 12′, and one end of a double-acting hydraulic cylinder-and-piston unit 22 is secured to a pivot pin 21 of the member 19. The free end of the piston rod 23 which extends out of the unit 22 from the non-illustrated piston therein, is pivoted at 24 to the lever 13. The same arrangement will of course be provided at the non-illustrated opposite end of the machine.

After the levers 13 are in position in the solid-line position of FIG. 2, and the cylinder-and-piston units 22 are mounted as shown in FIG. 2, the screws 18 are turned until they engage the respectively associated trunnions 8. Thereupon the sections 53 of the two journals 5 are removed and the cylinder-and-piston units 22 both receive pressure fluid in a sense causing their piston rods 23 to extend and pivot the levers 13 (towards the left in FIG. 2) until the longitudinal axis of the levers 13 are vertically oriented. When this position is reached, the adjusting screws 18 are backed off until their outer ends are withdrawn into the tapped bores 17 so that the trunnions 8 are now in engagement with the respective abutment surfaces 16′ (and, of course, with the abutment surfaces 16 as before). Additional pressure fluid is now supplied to the cylinder-and-piston units 22 to cause the piston rods 23 thereof to be further extended until the levers 13 have been pivoted to the outer end positions shown in broken lines in FIG. 2. The grinding roll 1 is now freely accessible outside the machine and can be transferred to a transporter that will take it away, or it can be engaged by a hoist or the like. It should be noted that even in the broken-line position of the levers 13, the trunnions 8 engage the abutment surfaces 16 or 16' of each receiver so that the grinding roller 1 cannot roll out of the respective receiver.

When a new grinding roller 1 (or the reworked one) is now to be installed in the mill, the grinding roller is placed with its trunnion 8 into the receivers of the arms or levers 13 which at this time are in the broken-line position of FIG. 2. Thereupon pressure fluid is admitted into the cylinder-and-piston units 22 in a sense causing their piston rods 23 to retract, whereby the levers 13 are pivoted in clockwise direction to the solid-line position of FIG. 2. The screws 18 are now turned into engagement with the trunnions 8, and farther until the trunnions 8 have been shifted on the abutment surfaces 16 to a position in which the trunnion axis coincides with the axis of the respective journal 5, where the grinding roller 1 is now maintained in centered position with reference to the sections 51. The sections 53 are then mounted in place by means of the screws 52, and the replacement of the grinding roll 1 is now completed, so that the levers 13 and the cylinder-and-piston units 22 can be removed.

It will be appreciated that in this manner it is possible to remove a grinding roll and replace it later on, or replace it with another one, without any danger of scratching, squeezing, or other damage to either the roll, the trunnions, or the journals.

The removal and installation of the grinding roll 2 is carried out in an analogous manner, for which purpose the levers 13 are mounted on the pivots 11, and the members 19 are mounted via the screws 20 in the tapped bores 12.

Figure 5:
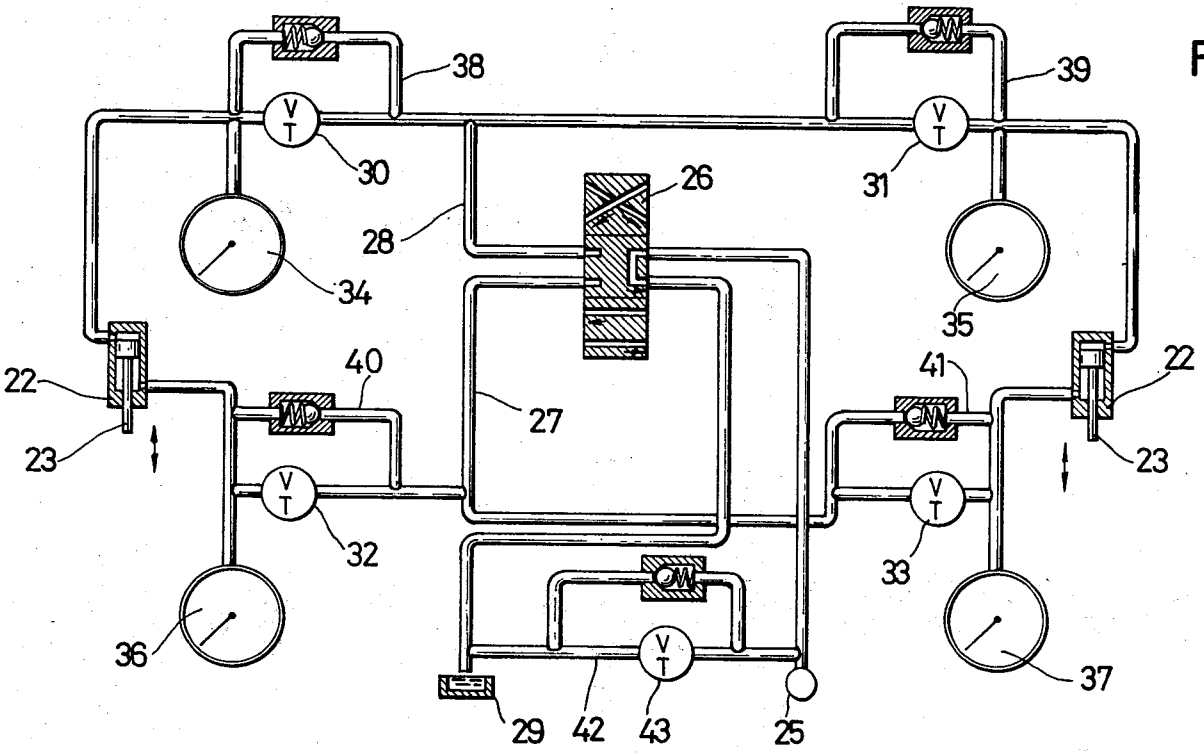
FIG. 5 is a control diagram illustrating a hydraulic control system for use with the embodiment of FIGS. 1–4.

The control of the operations of the double-acting cylinder-and-piston units 23 may be carried out with an arrangement such as is shown by way of example in FIG. 5. This arrangement utilizes a source 25 of pressure fluid, advantageously the same source which supplies pressurized fluid to the mill when the latter is in operation. The source 25 is connected with the extension pressure chambers of the units 22 via a four-way valve 26. When the levers 13 are to be moved from the broken-line to the full-line position of FIG. 2, the source is connected with the opposite retraction pressure chambers of the units 22 via a fluid line 27. The other pressure chambers of the units 22 are at this time connected with a reservoir 29 via a fluid line 28. When the levers 13 are to be moved from the full-line to the broken-line position of FIG. 2, the line 28 is connected to the pressure fluid source 25 via the four-way valve 26, and the line 27 is connected via the valve with the reservoir 29.

Each pressure chamber in the two units 22 has arranged in its associated fluid line a throttle 30, 31, 32 or 33, respectively, as well as a pressure-indicating instrument 34–37, respectively. Each of the throttles 30–33 is bridged by a line 38–41, respectively, each of which accommodates a one-way valve as illustrated. This means that the pressure chambers of the units 22 can receive pressurized fluid independently of the setting of the throttles 30–33, whereas the return flow of the pressure fluid from the pressure chambers is regulated by setting the throttles 30–33 to a desired cross section. This is particularly important if and when the levers 13 are to be moved to their broken-line position while supporting the grinding roll 1 or 2, because it is then necessary that the outflow of the pressure medium be throttled so strongly that the grinding roll 1 or 2 can be lowered only slowly by the levers 13. The pressure exerted upon the system by the source 25 can be regulated by a bypass 42 with an interposed throttle 43; this is advantageous during movement of the levers 13 to the broken-line position, and during the beginning of their movement back towards their full-line position. In the first case the piston is relieved when the weight of the roll 1 or 2 presses upon the levers 13, and in the second case a smoother starting of the movement is obtained.

It is advantageous if the elements 26–43 shown in FIG. 5 are combined in a control box S that is diagrammatically shown in FIG. 2 and which is advantageously portable so that it can be taken from machine to machine and mounted laterally on the support 3, 4 when one of the grinding rolls is to be removed or installed. Moreover, such a mounting permits the box S to be so located that the control levers or the like which operate the system of FIG. 5 are readily visible and operable.

It is clear, of course, that the system of FIG. 5 could be replaced with a different drive system, for example a spindle or the like.

The invention achieves all of the objects and advantages which have been outlined above as being desirable. The removal and installation of a grinding roll can be carried out in a matter of only a few minutes, and no auxiliary tools at all are required. This reduces the labor expenses and the down-time for the machine, which is of considerable economic importance. In particular, the invention permits an exchange of grinding rolls without danger of damage to any of the components, and even more importantly, without danger of injury to any of the personnel involved. It is self-evident that the arrangement is applicable to other situations where rolls must be removed from or installed in a machine under analogous circumstances, and is not limited to a particular type of grinding roll.

The adjusting arrangement utilizing the screw 18 could be replaced with a different analogously acting arrangement, for example a hydraulic cylinder-and-piston unit.

It is clear that instead of using a single pair of levers 13, which are moved from one set of pivots 10 to the other set of pivots 11, or vice versa, it would be possible to use two pair of levers 13. However, the illustrated embodiment has the virtue of requiring fewer components and being less expensive. In fact, it is possible to use a single pair of levers 13 for two or more machines since they can be readily moved from one machine to the next. If the orientation of the longitudinal axis of the roll 1 or 2 requires to be slightly changed, this can be accomplished by pivoting one lever 13 slightly with reference to the opposite lever.

It will be understood that each of the elements described above, or two or more together, may also find a useful application in other types of constructions differing from the types described above.

While the invention has been illustrated and described as embodied in a grinding mill, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A grinding mill, comprising support means; grinding rolls each having opposite axial ends provided with respective trunnions; open-and-shut journals for the respective trunnions; displacing means engageable with the trunnions of each grinding roll and pivotable between a first end position in which the trunnions of a respective grinding roll are located in their associated journals, and a second end position in which the grinding roll and the trunnions thereof are laterally displaced relative to said first position and supported by said displacing means, said displacing means comprising a pair of levers each having a first end portion, and a second end portion provided with a receiver for a respective trunnion, and mounting means mounting said first end portions on said support means so that said levers have freedom of pivoting movement for said second end portions to move to said first and second positions, respectively; and adjusting means for adjusting the position of a respective trunnion within the associated receiver.

2. A grinding mill as defined in claim 1, wherein said journals are bi-partite and each includes a fixed section and a removable section.

3. A grinding mill as defined in claim 2, wherein said sections engage one another in a substantially vertical plane of separation.

4. A grinding mill as defined in claim 1, wherein said mounting means are located downwardly of said journals.

5. A grinding mill as defined in claim 1; and further comprising motion-imparting means connected with said levers for effecting said pivoting movement thereof.

6. A grinding mill as defined in claim 5, wherein said motion-imparting means comprises double-acting cylinder-and-piston units each having opposite end portions which are pivotally connected to said support means and to one of said levers, respectively.

7. A grinding mill as defined in claim 6; and further comprising control means for said cylinder-and-piston units.

8. A grinding mill as defined in claim 7, wherein said control means comprises a fluid reservoir and a source of pressure fluid, fluid lines connecting each of said units with said reservoir and with said source, and throttles in said fluid lines.

9. A grinding mill as defined in claim 1, wherein said mounting means comprises pivots on said support means, and journal portions on said first end portions and adapted to receive the respective pivots.

10. A grinding mill as defined in claim 9, wherein each of said receivers comprises a first abutment surface and a second abutment surface extending substantially normal thereto, said first abutment surface extending in a plane which intersects at an acute angle a tangent on the arcuate path traversed by the respective trunnion during movement between said positions, and further comprising an adjusting screw elongated in substantial parallelism with said first abutment surface and threaded into a tapped bore formed in said second abutment surface.

11. A grinding mill as defined in claim 10, wherein said adjusting screw is located at one side of a longitudinal center plane of the respective lever; and wherein said displacing means includes motion-imparting cylinder and piston units each having one end pivoted to one of said levers at the opposite side of said center plane, and another end provided with connecting means for pivotal connection to said support means.

12. A grinding mill as defined in claim 5, wherein said motion-imparting means effect the pivoting movement of said levers between said first end position in which said second end portions are located inwardly of the contour of said support means, and said second end position in which said second end portions are located outwardly of said contour.

13. A grinding mill as defined in claim 12, wherein said levers each have a longitudinal axis extending through said first and second end portions; and wherein said mounting means are so located that said axes include an acute angle with a vertical central plane intersecting the respective trunnions, when said levers are in said first end positions, so that the weight of the respective roll tends to maintain said levers in said first end positions and prevents undesired pivoting to said second end positions.

14. A grinding mill as defined in claim 1; and further comprising control means for said displacing means.

15. A grinding mill, comprising support means; grinding rolls each having opposite axial ends provided with respective trunnions; open-and-shut journals for the respective trunnions; displacing means engageable with the trunnions of each grinding roll and pivotable between a first end position in which the trunnions of a respective grinding roll are located in their associated journals, and a second end position in which the grinding roll and the trunnions thereof are laterally displaced relative to said first position and supported by said displacing means, said displacing means comprising a pair of levers each having a first end portion, and a second end portion provided with a receiver for a respective trunnion, and mounting means mounting said first end portions on said support means so that said levers have freedom of pivoting movement for said second end portions to move to said first and second positions, respectively, said receivers each having an abutment surface which is upwardly inclined when the respective lever is in the first end position thereof; and an adjusting screw mounted at a location upwardly of said abutment surface and being elongated in substantial parallelism therewith and transverse to a trunnion supported thereon.

16. A grinding mill, comprising support means; grinding rolls each having opposite axial ends provided with respective trunnions; open-and-shut journals for the respective trunnions; displacing means engageable with the trunnions of each grinding roll and pivotable between a first end position in which the trunnions of a respective grinding roll are located in their associated journals, and a second end position in which the grinding roll and the trunnions thereof are laterally displaced relative to said first position and supported by said displacing means, said displacing means comprising a pair of levers each having a first end portion, and a second end portion provided with a receiver for a respective trunnion, and mounting means mounting said first end portions on said support means so that said levers have freedom of pivoting movement for said second end portions to move to said first and second positions, respectively, said receivers each having an abutment surface which is upwardly inclined when the respective lever is in the first end position thereof; and an adjusting screw mounted at a location upwardly of said abutment surface and being elongated in substantial parallelism therewith and transverse to a trunnion supported thereon, said receivers each further comprising another abutment surface extending upwardly from the first-mentioned abutment surface substantially normal thereto, said other abutment surface being formed with a tapped bore into which said adjusting screw is threaded.

17. Displacing means for a grinding mill comprising a pair of levers each having a first end portion, and a second end portion provided with a receiver for a respective trunnion of a grinding roll, and journal portions for mounting said first end portions on support means of the grinding mill so that said levers have freedom of pivoting movement for said second end portions; and adjusting means for adjusting the position of a respective trunnion within the associated receiver.

18. Displacing means as defined in claim 17; and further comprising motion-imparting means connected with said levers for effecting said pivoting movement thereof.

19. Displacing means as defined in claim 18, wherein said motion-imparting means comprises double-acting cylinder-and-piston units each having opposite end portions which are pivotally connected to said support means and to one of said levers, respectively.

20. Displacing means as defined in claim 19; and further comprising control means for said cylinder-and-piston units.

21. Displacing means as defined in claim 20, wherein said control means comprises a fluid reservoir and a source of pressure fluid, fluid lines connecting each of said units with said reservoir and with said source, and throttles in said fluid lines.

22. Displacing means as defined in claim 17; comprising control means.

23. Displacing means for a grinding mill comprising a pair of levers each having a first end portion, and a second end portion provided with a receiver for a respective trunnion of a grinding roll, and journal portions for mounting said first end portions on support means of the grinding mill so that said levers have freedom of pivoting movement for said second end portions, said receivers each having an abutment surface which is upwardly inclined when the respective lever is in the first end position thereof; and an adjusting screw mounted at a location upwardly of said abutment surface and being elongated in substantial parallelism therewith and transverse to a trunnion supported thereon.

24. Displacing means for a grinding mill comprising a pair of levers each having a first end portion, and a second end portion provided with a receiver for a respective trunnion of a grinding roll, and journal portions for mounting said first end portions on support means of the grinding mill so that said levers have freedom of pivoting movement for said second portions, said receivers each having an abutment surface which is upwardly inclined when the respective lever is in the first end position thereof; and an adjusting screw mounted at a location upwardly of said abutment surface and being elongated in substantial parallelism therewith and transverse to a trunnion supported thereon, said receivers each further comprising another abutment surface extending upwardly from the first-mentioned abutment surface substantially normal thereto, said other abutment surface being formed with a tapped bore into which said adjusting screw is threaded.

25. Displacing means for a grinding mill comprising a pair of levers each having a first end portion, and a second end portion provided with a receiver for a respective trunnion of a grinding roll, and journal portions for mounting said first end portions on support means of the grinding mill so that said levers have freedom of pivoting movement for said second portions, each of said receivers comprising a first abutment surface and a second abutment surface extending substantially normal thereto, said first abutment surface extending in a plane which intersects at an acute angle a tangent on the arcuate path traversed by the respective trunnion during movement between said positions; an adjusting screw elongated in substantial parallelism with said first abutment surface and threaded into a tapped bore formed in said second abutment surface; motion-imparting means connected with said levers for effecting said pivoting movement thereof, said motion-imparting means comprising double-acting cylinder-and-piston units each having opposite end portions which are pivotally connected to said support means and to one of said levers, respectively; and control means for said cylinder-and-piston units, said control means comprising a fluid reservoir and a source of pressure fluid, fluid lines connecting each of said units with said reservoir and with said source, and throttles in said fluid lines.

26. Displacing means as defined in claim 25, wherein said adjusting screw is located at one side of a longitudinal center plane of the respective lever; and wherein motion-imparting cylinder and piston units each having one end pivoted to one of said levers at the opposite side of said center plane, and another end provided with connecting means for pivotal connection to said support means.

* * * * *

UNITED STATES PATENT AND TRADEMARK OFFICE

CERTIFICATE OF CORRECTION

PATENT NO. : 3,970,256

DATED : July 20, 1976

INVENTOR(S) : Edgar Rüegger et al.

It is certified that error appears in the above-identified patent and that said Letters Patent are hereby corrected as shown below:

In the heading [73], the name and address of the assignee should read -- Gebrueder Buehler A G, St. Gallen, Switzerland --.

Signed and Sealed this

First Day of February 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,970,256

DATED : July 20, 1976

INVENTOR(S) : Edgar Rüegger et al.

It is certified that error appears in the above-identified patent and that said Letters Patent are hereby corrected as shown below:

In the heading [73], the name and address of the assignee should read --Gebrueder Buehler AG, Uzwil, St. Gallen, Switzerland--.

THIS CERTIFICATE SUPERSEDES CERTIFICATE OF CORRECTION ISSUED February 1, 1977.

Signed and Sealed this

*Twenty-ninth* Day of *April 1980*

[SEAL]

*Attest:*

SIDNEY A. DIAMOND

*Attesting Officer*

*Commissioner of Patents and Trademarks*